US005372703A

United States Patent [19]

Kamiya et al.

[11] Patent Number: 5,372,703

[45] Date of Patent: Dec. 13, 1994

[54] LUBRICATING OILS

[75] Inventors: Kouzou Kamiya; Isao Honjo; Toshio Yoshida; Masaru Ushio; Jinichi Igarashi; Masakuni Hirata; Mitsuo Okada; Yuji Ikemoto; Kouichi Oshima; Hiroyuki Takashima, all of Yokohama, Japan

[73] Assignee: Nippon Oil Co., Ltd., Japan

[21] Appl. No.: 47,040

[22] Filed: Apr. 12, 1993

Related U.S. Application Data

[63] Continuation of Ser. No. 633,947, Dec. 26, 1990, abandoned.

[30] Foreign Application Priority Data

| | | | |
|---|---|---|---|
| Dec. 26, 1989 | [JP] | Japan | 1-337224 |
| Dec. 28, 1989 | [JP] | Japan | 1-343390 |
| May 31, 1990 | [JP] | Japan | 2-142546 |
| Jul. 9, 1990 | [JP] | Japan | 2-181038 |
| Sep. 10, 1990 | [JP] | Japan | 2-239500 |

[51] Int. Cl.[5] ..... C10G 71/00

[52] U.S. Cl. ..... 208/58; 208/14; 208/18; 208/19; 208/96; 208/97; 585/6.6; 585/13

[58] Field of Search ..... 208/14, 19, 96, 97, 208/58; 585/6.6, 13

[56] References Cited

U.S. PATENT DOCUMENTS

| | | | |
|---|---|---|---|
| 3,730,876 | 5/1973 | Sequeira, Jr. | 208/96 |
| 3,753,188 | 8/1973 | Miyoshi et al. | 208/14 |
| 3,766,055 | 10/1973 | Cummins et al. | 208/96 |
| 4,033,854 | 7/1977 | Ohmori et al. | 208/97 |
| 4,058,451 | 11/1977 | Stolfa | 208/97 |
| 4,069,166 | 1/1978 | Masunagu et al. | 208/14 |
| 4,072,620 | 2/1978 | Masunagu et al. | 208/14 |
| 4,402,841 | 9/1983 | Schiemann | 208/19 |
| 4,764,266 | 8/1985 | Chen et al. | 208/96 |
| 4,770,763 | 9/1988 | Kusayanagi et al. | 208/96 |
| 4,800,013 | 1/1989 | Yamane et al. | 208/14 |
| 4,800,029 | 1/1989 | Dasai | 208/18 |
| 4,802,058 | 1/1989 | Kawakami et al. | 208/14 |
| 4,906,350 | 3/1990 | Lucien et al. | 208/18 |
| 4,911,821 | 3/1990 | Katzen et al. | 208/96 |
| 4,983,313 | 1/1991 | Kanoko et al. | 208/18 |

*Primary Examiner*—Helane Myers

*Attorney, Agent, or Firm*—Bruce L. Adams; Van C. Wilks

[57] ABSTRACT

Lubricant base oils are made up essentially of 2–15% by weight of a total aromatics content, greater than 60% by weight of isoparaffins and monocyclic naphthenes in total, more than 30% by weight of alkylbenzenes in the total aromatics content and smaller than 4% by weight of tricyclic and tetracyclic aromatics in the total aromatics content. The base oil has great viscosity index, small pour point, high oxidative stability and heat stability and sufficient capability to dissolve sludge.

14 Claims, 1 Drawing Sheet

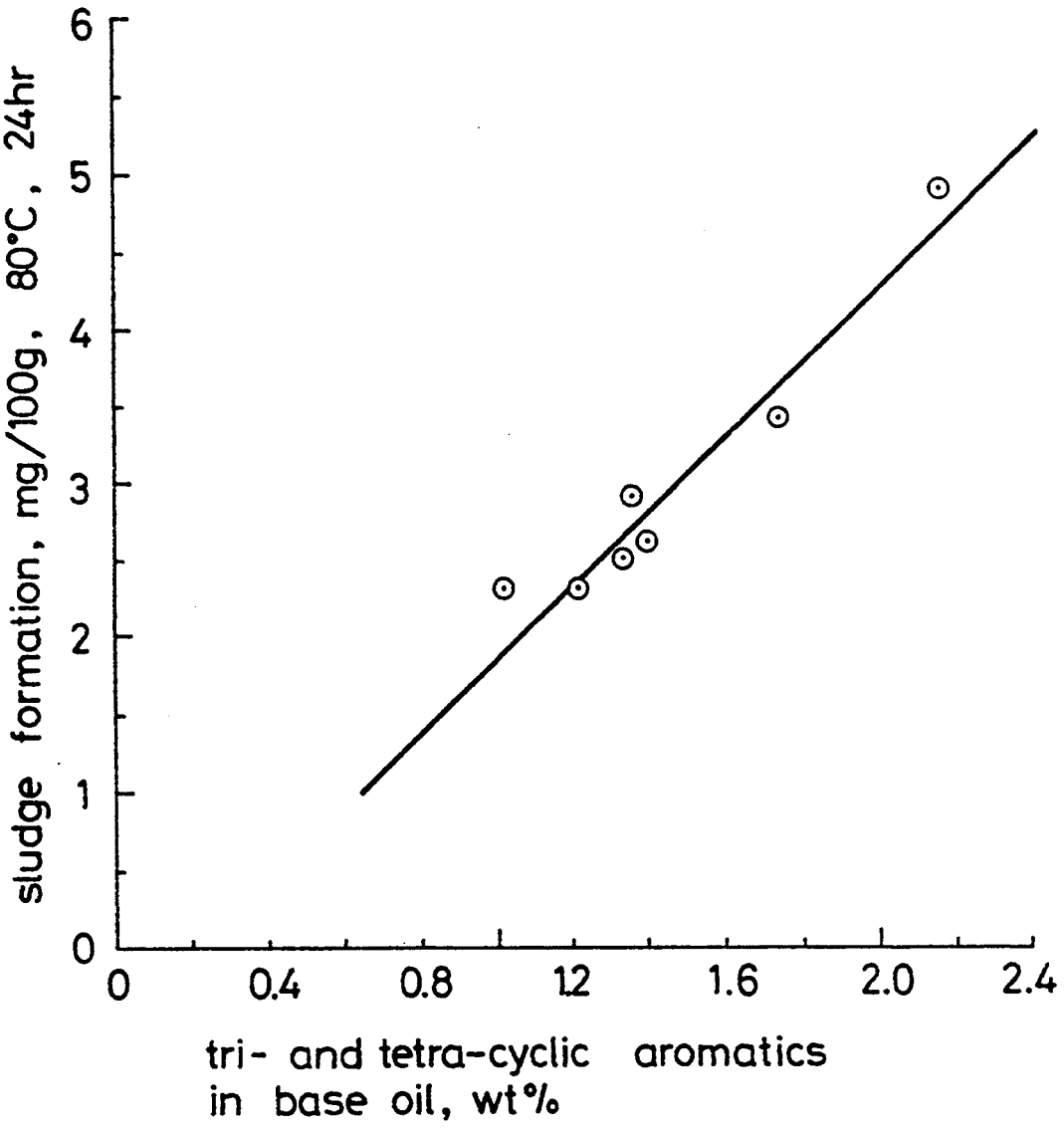
sludge formation, mg/100g, 80°C, 24hr
0
1
2
3
4
5
6
0
0.4
0.8
1.2
1.6
2.0
2.4
tri- and tetra-cyclic aromatics
in base oil, wt%

LUBRICATING OILS

This is a continuation of application Ser. No. 07/633,947 filed Dec. 26, 1990 now abandoned.

BACKGROUND OF THE INVENTION

1. Technical Field

This invention relates to base oils suitable for use in lubricants of enhanced performance and also to a process for the production of such a base oil using a specified set of reaction conditions.

2. Prior Art

As a result of technical innovations in an industrial sector of machinery, there have recently aroused sophisticated automotive engines, compact hydraulic equipment for use at high pressure and with high precision compressors apparatus of high performance and economy size and various other machine tools of good machinability. To cope with this trend, lubricating oils are literally required which are sufficient in service life even under adverse conditions, economical in energy and free from environmental pollution. Several base oils for lubricants of the character mentioned are known in common use.

Prior methods of base oil production as by solvent refining are rather dependent upon a limited grade of starting oil of good quality and hence high cost because oil fractions are generally variable or irregular in nature with their sources of supply. In an effort to solve this problem an advanced method has been proposed in which starting oils can be used from a diversified source of supply. Such method involves hydrocracking a given oil fraction and thereafter subjecting the thus treated oil to hydrofinishing, both steps at elevated pressure. The resulting base oil is acceptable in regard to great viscosity and small pour point.

The above hydrocracking method, however, has a drawback in that it needs a reaction pressure as high as 200 kg/cm$^2$, meaning large plant investment. Furthermore, the resultant base oil is objectionably rich in polycyclic naphthenes which are liable to cause malfunction and conversely poor in alkylbenzenes which are desirable as serving to dissolve sludge which would generate from any additive in the ultimate lubricant or from that lubricant per se.

SUMMARY OF THE INVENTION

The present inventors have now found that mineral base oils for lubricants of specific compositions and characteristics can exhibit great viscosity index, sufficient oxidative stability and adequate heat stability. It has also been found that such a base oil can be obtained by hydrocracking a selected oil fraction at low pressure and at low liquid hourly space velocity (LHSV), followed by dewaxing and dearomatization.

The invention therefore seeks to provide a new base oil for use in lubricants which is great in viscosity index, small in pour point, high in oxidative stability and heat stability and capable of sludge dissolution. The invention further seeks to provide a process for producing such base oil with utmost economy.

Many other advantages of the invention will become better understood from the following description.

More specifically, one aspect of the invention provides a base oil for use in lubricants which comprises: (a) 2–15% by weight of a total aromatics content, (b) greater than 60% by weight of isoparaffins and monocyclic naphthenes in total in a saturates content, (c) more than 30% by weight of alkylbenzenes in the total aromatics content and (d) smaller than 4% by weight of tricyclic and tetracyclic aromatics in the total aromatics content, whereby the base oil has a viscosity index of larger than 105 and a pour point of lower than −10° C.

Another aspect of the invention provides a process for producing base oils for use in lubricants which comprises: (1) hydrocracking a starting oil fraction to a cracking ratio of higher than 40% by weight in the presence of a hydrocracking catalyst at a total pressure of lower than 150 kg/cm$^2$, at a temperature of 360°–440° C. and at a liquid hourly space velocity (LHSV) of smaller than 0.5 hr$^{-1}$, the starting oil fraction being a vacuum gas oil (WVGO), an oil (HIX) resulting from mild hydrocracking (MHC) of WVGO, a mixed oil of WVGO and HIX, a deasphalted oil (DAO), an MHC oil of DAO or a mixed oil of DAO and DAO-MHC oil, (2) recovering an oil fraction as hydrocracked or a lubricating cut alone and (3) dewaxing and thereafter dearomatizing the fraction or cut of (2), or the dewaxing following the dearomatization, thereby obtaining a base oil comprising: (a) 2–15% by weight of a total aromatics content, (b) greater than 60% by weight of isoparaffins and monocyclic naphthenes in total in a saturates content, (c) more than 30% by weight of alkylbenzenes in the total aromatics content and (d) smaller than 4% by weight of tricyclic and tetracyclic aromatics in the total aromatics content, whereby the base oil has a viscosity index of larger than 105 and a pour point of lower than −10° C.

A still another aspect of the invention provides a process for producing base oils for use in lubricants which comprises: (1) hydrocracking a starting oil fraction to a crack ratio of higher than 40% weight in the presence of a hydrocracking catalyst at a total pressure of lower than 150 kg/cm$^2$, at a temperature of 360°–440° C. and at a liquid hourly spaced velocity (LHSV) of smaller than 0.5 hr$^{-1}$, the starting oil fraction being a vacuum gas oil (WVGO), an oil (HIX) resulting from mild hydrocracking (MHC) of WVGO, a mixed oil of WVGO and HIX, a deasphalted oil (DAO), an MHC oil of DAO or a mixed oil of DAO and DAO-MHC oil, (2) recovering an oil fraction as hydrocracked or a lubricating cut alone and (3) dewaxing and then dearomatizing the fraction or cut of (2), or the dewaxing following the dearomatization, thereby obtaining a base oil comprising: (a) 2–15% by weight of a total aromatics content, (b) greater than 60% by weight of isoparaffins and monocyclic naphthenes in total in a saturates content, (c) more than 30% by weight of alkylbenzenes in the total aromatics content and (d) smaller than 4% by weight of tricyclic and tetracyclic aromatics in the total aromatics content, the base oil meeting one of the following requirements: (e) a viscosity index of higher than 105 and a pour point of lower than −10° C. as a 70 pale cut, (f) a viscosity index of higher than 115 and a pour point of lower than −10° C. as an SAE-10 cut, (g) a viscosity index of higher than 120 and a pour point of lower than −10° C. as an SAE-20 cut and (h) a viscosity index of higher than 120 and a pour point of lower than −10° C. as an SAE-30 cut.

BRIEF DESCRIPTION OF THE DRAWING

The accompanying drawing is a graphic representation of the correlation between the amount of sludge and the content of tricyclic and tetracyclic aromatics in the base oil according to the present invention.

DETAILED DESCRIPTION OF THE INVENTION

The lubricant base oils of the present invention are designed to have the following characteristic compositions.

(a) A total aromatics content should be in the range of 2–15% by weight, preferably 3–10% by weight. Below 2% would fail to dissolve sludge which will develop from any additive in the final lubricant or from the lubricant itself during actual use. Above 15% would be susceptible to insufficient oxidation stability.

Aromatics usually include alkylbenzenes, alkylnaphthalenes, anthracenes and phenathrenes and their alkylates, compounds of the type having condensed tetra- or more polycyclic benzene rings and compounds having bonded a heteroaromatic type of pyridine, quinoline, phenol, naphtol or the like.

(b) Isoparaffins and monocyclic naphthenes should be in a total content of more than 60% by weight in a saturates content, preferably greater than 65% by weight.

The two components contribute greatly to increased viscosity index and improved resistance to oxidation and to heat. Quantitative measurement is based on gas chromatography and mass spectrometry.

(c) Alkylbenzenes in total aromatics content should exceed in amount 30% by weight, preferably beyond 40% by weight.

These components have an important role to dissolve sludge and to improve viscosity index. Contained in alkylbenzenes are compounds in which one or more alkyl groups are chemically bonded to benzene, and the like.

(d) Tri- and tetra-cyclic aromatics present in the total aromatics content should be less than 4% by weight, preferably smaller than 3% by weight.

The heat stability of the base oil has now been confirmed to be fairly negatively correlative with the content of the tri - and tetra-cyclic aromatics as seen in the accompanying drawing. It has thus been found that lubricating cuts derived by hydrocracking at medium or low pressure and at low liquid hourly space velocity (LHSV) can be dearomatized with good selectivity to effectively remove tri-, tetra- and penta-cyclic and other polycyclic aromatics without decline in alkylbenzene contents.

Importantly, the base oil of compositions (a) to (d) according to the invention should have a viscosity index of larger than 105 and a pour point of lower than −10° C. Furthermore, the base oil of the invention should preferably meet one of the following requirements.

(e) The viscosity index should be higher than 105, preferably more than 110, and the pour point lower than −10° C., preferably less than −25° C., as a 70 pale cut.

(f) The viscosity index should be more than 115, preferably above 120, and the pour point less than −10° C., preferably below −15° C. as an SAE-10 cut.

(g) The viscosity index should be higher than 120, preferably more than 125, and the pour point lower than −10° C., preferably less than −15° C. as an SAE-20 cut.

(h) The viscosity index should be greater than 120, preferably above 125, and the pour point lower than −10° C., preferably below −15° C. as an SAE-30 cut.

The base oil of the invention may be produced by hydrocracking a starting oil fraction to a cracking ratio of higher than 40% by weight in the presence of a hydrocracking catalyst at a total pressure of lower than 150 kg/cm$^2$, at a temperature of 360°–440° C. and at an LHSV of smaller than 0.5 hr$^{-1}$ and by recovering an oil fraction as hydrocracked or a lubricating cut alone and subsequently by dewaxing and dearomatizing the fraction or cut. The step of dearomatization may be effected prior to the step of dewaxing. Suitable starting oil fractions may be chosen from a vacuum gas oil (WVGO), an oil (HIX) obtained by mild hydrocracking (MHC) of WVGO, a mixed oil of WVGO and HIX, a deasphalted oil (DAO), an MHC oil of DAO and a mixed oil of DAO and DAO-MHC oil.

WVGO is an oil obtained by vacuum distillation of a residual oil generated upon atmospheric distillation of crude oil. This oil fraction may preferably boil at 360°–530° C.

HIX is a vacuum gas oil of a heavy type derivable by MHC. By MHC is meant a relatively mild process of hydrocracking at a total pressure of lower than 100 kg/cm$^2$, preferably 60–90 kg/cm$^2$, at a temperature of 370°–450° C., preferably 400°–430° C. and at an LHSV of 0.5–4.0 hr$^{-1}$, preferably 1.0–2.0 hr$^{-1}$ and in a cracking ratio of 20–30% by weight at 360° C. Catalysts for use in MHC are those having Groups VI and VIII metals deposited on a carrier such as alumina, silica-alumina, alumina-boria or the like. In the case of an alumina carrier, there may be used a promotor such as of a phosphorus compound. Group VI metals such as for example molybdenum, tungsten and chromium are deposited in an amount of 5–30% by weight, preferably 10–25% by weight, and Group VIII metals such as for example cobalt and nickel in an amount of 1–10% by weight, preferably 2–10% by weight.

A mixed oil of WVGO and HIX may preferably contain more than 50% by weight of HIX.

DAO is a substantially asphaltene-free oil obtainable by treatment of a residual oil as by propane deasphaltation, which residual oil results from vacuum-distilling a residual oil generating by atmospheric distillation of crude oil.

In the practice of the invention the step of hydrocracking may be conducted in the presence of a hydrocracking catalyst later described at a total pressure of smaller than 150 kg/cm$^2$, preferably 130–100 kg/cm$^2$ on a medium or low level, at a temperature of 360°–440° C., preferably 370°–430° C. and at an LHSV of 0.5 hr$^{-1}$, preferably 0.2–0.3 hr$^{-1}$. A ratio of hydrogen to starting oil fraction may be set at 1,000–6,000 scf/bbl, preferably 2,500–5,000 scf/bbl.

The term cracking ratio is such when a 360° C. cut in the starting oil fraction is hydrocracked and should be greater than 40% by weight, preferably beyond 45% by weight, more preferably above 50% by weight. With HIX employed as a starting oil fraction, the sum of the cracking ratios of HIX and in MHC should be rendered beyond 60% by weight, preferably larger than 70% by weight. Where part of hydrocracked oil is recycled, the cracking ratio is used to refer to one for a fresh feed oil, but not one in which recycled oil is included.

The hydrocracking catalyst eligible for the invention may be preferably of a dual function; namely, it has a point of hydrogenation made up of Groups VIb and VIII metals and a point of cracking composed as a carrier of a composite oxide of Groups III, IV and V metals. Group VIb may be selected from tungsten and molybdenum and Group VIII metals from nickel, cobalt and iron. These metals after being supported on a given composite oxide carrier is used usually in a sulfide form. Suitable composite carriers include silica-alumina, silica-zirconia, silica-titania, silica-magnesia, silica-alumina-zirconia, silica-alumina-titania, silica-alumina-mganesia and the like. There may also be utilized crystalline silica-alumina (zeolite), crystalline alumina-phosphate (ALPO) and crystalline silica-alumina-phosphate (SAPO).

Group VIb metal specified above should be deposited on the carrier in an amount of 5–30% by weight, preferably 10–25% by weight, and Group VIII metal specified above in an amount of 1–20% by weight, preferably 5–15% by weight. Prior to charge of the hydrocracking catalyst, it is convenient where desirable to add a pretreating catalyst which is capable of desulfurization and denitrogenation, such as a catalyst derivable from deposition of a Group VIII metal on alumina, alumina-boria or the like and from subsequent sulfurization. In such instance the carrier may be combined for example with a phosphorus compound promotor.

Upon completion of hydrocracking, the oil fraction is recovered as hydrocracked or as a lubricating cut alone. This cut may be separated by ordinary distillation as a 70 pale cut boiling at 343°–390° C., an SAE-10 cut boiling at 390°–445° C., an SAE-20 boiling at 445°–500° C. or an SAE-30 cut boiling at 500°–565° C.

The above oil fraction hydrocracked or lubricating cut separated is thereafter dewaxed and dearomatized, or vice versa. The dewaxing step may be of a solvent or catalytic type. Solvent dewaxing may be done in a known manner with use of a solvent such as benzene, toluene or acetone or a combined solvent of two or more of benzene, toluene and methyl ethyl ketone (MEK) with control of cooling temperatures, thereby providing a dewaxed oil having a desired pour point. Volume ratios of solvent to oil may be in the range of 0.5–5.0, preferably 1.0–4.5, and temperatures in the range of −5°−−45° C., preferably −10°−−40° C. Catalytic dewaxing may be accomplished as commonly known in the art in the presence of a pentasil zeolite catalyst and under a steam of hydrogen and with control of reaction temperatures so that a dewaxed oil is obtained with a desired pour point. Total pressures may be set at 10–70 kg/cm$^2$, preferably 20–50 kg/cm$^2$, reaction temperatures at 240°–400° C., preferably 260°–380° C., and LHSVs 0.1–3.0 hr$^{-1}$, preferably 0.5–2.0 hr$^{-1}$.

The step of dearomatization may be effected by solvent treatment or high pressure hydrogenation. Specific examples of solvents for solvent treatment include furfural, phenol, N-methyl-2-pyrrolidone (NMP) and the like. Furfural and NMP are more preferred and NMP most preferred. Solvent to oil ratios may be set smaller than 4, preferably less than 3, more preferably below 2, at a reaction temperature of 70°–150° C. to thereby obtain raffinate in a yield of more than 60% by volume, preferably greater than 70% by volume, more preferably above 85% by volume. High pressure hydrogenation may be carried out in the presence of a catalyst at 150–200 kg/cm$^2$ in total pressure, preferably 170–200 kg/cm$^2$, at 280°–350° C. in temperature, preferably 300°–330° C. and at 0.2–2.0 hr$^{-1}$ in LHSV, preferably 0.5–1.0 hr$^{-1}$. In this reaction the catalyst results from deposition of Groups VIb and VIII metals on alumina and from subsequent sulfurization. Group VIb metals are chosen from molybdenum, tungsten and chromium and may be supported in an amount of 5–30% by weight of the carrier, preferably 10–25% by weight. Group VIII metals include cobalt and nickel and may range in amount from 1 to 10% by weight of the carrier, preferably 2 to 10% by weight. Solvent dearomatization is convenient in the practice of the invention.

When it is found desirable, the oil fraction solvent-dearomatized may be hydrogenated at a low total pressure of below 50 kg/cm$^2$, preferably 25–40 kg/cm$^2$, with use of a catalyst obtained by deposition of Groups VIb and VIII metals on an alumina carrier and by subsequent sulfurization. Group VIb metals may be molybdenum, tungsten or chromium in an amount of 5–30% by weight of the carrier, preferably 10–25% by weight, whereas Group VIII metals may be cobalt or nickel in an amount of 1–10% by weight, preferably 2–10% by weight. Hydrogenation at such a low pressure leads to a solvent-dearomatized oil with conspicuous improvement in photostability.

The base oil of the invention can be reduced in its total aromatics content at below 1% so as to suit particular application. This may be conducted, subsequent to solvent dearomatization, at 80–150 kg/cm$^2$ in pressure, at 250°–350° C. in temperature and at 0.2–2.0 hr$^{-1}$ in LHSV and in the presence of a hydrogenating catalyst of the same composition as used for the above mode of low pressure hydrogenation.

In the case where the oil fraction is recovered as hydrocracked, it may be subjected to dewaxing and dearomatization and vice versa, or subsequent hydrogenation, thereby collecting a lubricating cut as a 70 pale cut of 343°–390° C., an SAE-10 cut of 390°–445° C., an SEA-20 cut of 445°–500° C. or an SAE-30 cut of 500°–565° C.

The base oil of the invention is preferably used alone or may be if necessary combined with any suitable known lubricant base oil of a mineral or synthetic class. Mineral base oils may be selected from paraffinic and naphthenic oils generated from refining of lubricating cuts as by solvent deasphaltation, solvent extraction, hydrocracking, solvent dewaxing, catalytic dewaxing, hydrogenation refining, sulfuric acid washing and clay treatment in combination, which cuts are derived by atmospheric and vacuum distillations of crude oil. Synthetic base oils include poly-α-olefins such as polybutene, 1-octene oligomer, 1-decene oligomer and the like, alkylbenzenes, alkylnaphthalenes, diesters such as ditridecylglutarate, di-2-ethylhexyladipate, diisodecyladipate, ditridecyladipate, di-3-ethylhexylsebacate and the like, polyol esters such as trimethylolpropanecaprylate, trimethylolpropanepelargonate, pentaerythritol-2-ethylhexanoate, pentaerythritolpelargonate and the like, polyoxyalkyleneglycols, polyphenylethers, silicone oils and perfluoalkylethers either alone or in combination. The base oil of the invention may preferably be admixed with a mineral or synthetic base oil in an amount of greater than 50% by weight of the total oil, preferably more than 70% by weight, more preferably above 90% by weight.

The base oil of the invention has a kinematic viscosity of 3.0–10.0 cSt at 100° C. as a lubricant for use in internal engines, 10–300 cSt at 40° C. as a hydraulic fluid, 10–150 cSt at 40° C. as a compressor lubricant and 1.0–120 cSt at 40° C. as a shock absorber lubricant.

Various other additives may be employed which are chosen from phenol-, amine-, sulfur-, zinc thiophosphate- and phenothiazine-based antioxidants, friction modifiers such as molybdenum dithiophosphate, molybdenum dithocarbamate, molybdenum disulfide, carbon fluoride, boric acid ester, aliphatic amine, higher alcohol, higher aliphatic acid, aliphatic acid ester and aliphatic amide, extreme pressure additives such as tricresylphosphate, triphenylphosphate and zinc dithiophosphate, abrasion preventives, corrosion inhibitors such as petroleum sulfonate, alkylbenzene sulfonate and dinonylnaphthalene sulfonate, metal inactivators such as benzotriazole, metal-based detergents such as alkaline earth metal sulfonate, alkaline earth metal phenate, alkaline earth metal salicylate and alkaline earth metal phosphate, ashless dispersants such as imide succinate, succinic acid ester, defoamers such as silicone, viscosity index improvers such as polymethacrylate, polyisobutylene and polystyrene, and pour point depressants. They may be used singly or in combination. The additives chosen may be used in a sum of 0.0005–30% by weight of the total lubricant composition. The viscosity index improver may be in a content within the range of 0.01–30% by weight, the defoamer within the range of 0.00001–1% by weight, the metal inactivator within the range of 0.001–1% by weight and any other additive within the range of 0.01–15% by weight.

The lubricant composition of the invention for application in internal combustion engines should preferably incorporate an ashless dispersant in an amount of 0.5–10 parts by weight per 100 parts by weight of the base oil, preferably 1–8 parts by weight. Specific examples include imide succinate and its derivatives, succinic acid esters, benzylamines, polyalkenylamines, polyoxyalkyleneaminoamides and the like. Imide succinate and derivatives thereof used herein are those obtained by reaction of a polyolefin in molecular weight from 300 to 3,000, such as polybutene, with maleic anhydride and by subsequent imidation with a polyamine such as tetraethylenepentamine, or by treatment of the reaction product, i.e. imide phthalate, with an aromatic polycarboxylic acid such as trimellitic acid or pyromellitic acid, thereby amidating part of the remaining amino group, or by further modification of the amidated compound with boric acid. Those derived from polyamine imidation are of a mono type which polyamine is added at one end with maleic anhydride and of a bis type in which polyamine is added at both ends with such anhydride.

Suitable succinic acid esters are made available by reacting a polyolefin in molecular weight from 300 to 3,000 with maleic anhydride, followed by esterification with a polyhydric alcohol such as glycerine, pentaerythritol or trimethylpropane.

Benzylamines according to the invention are such prepared by reacting a polyolefin of 300–3,000 in molecular weight, such as propylene oligomer or polybutene with a phenol, thereby forming an alkylphenol which is then reacted with formaldehyde and polyamine as is called the Mannich reaction.

Eligible polyalkenylamines are derivable by chlorination of a polyolefin of 300–3,000 in molecular weight, such as polybutene, and thereafter by reaction with ammonia or polyamine.

Where the lubricant composition of the invention is used as a hydraulic fluid, an antiwear agent should preferably be added in an amount of 0.01–10% by weight of the total composition, preferably 0.1–5% by weight. This additive acts to protect hydraulic pumps from wear. Specific examples include tricresylphosphate, triphenylphosphate, zinc dithiophate and various grades of sulfur.

The lubricant composition of the invention for use in compressive equipment should preferably have an antioxidant added in an amount of 0.01–5% by weight of the total composition, preferably 0.1–3% by weight. Included in antioxidants are those of a phenyl class such as 2,6-di-t-butyl-p-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-methylene bis(2,6-di-t-butylphenol), 4,4'-bis(2,6-di-t-butylphenol) and 4,4'-thiobis(6-t-butyl-o-cresol), those of an amine class such as diphenylamine, p,p'-dioctyldiphenylamine, p,p'-dinonyldiphenylamine, p,p'-didodecyldiphenylamine, phenyl-α-naphthylamine, p-octylphenyl-α-naphthylamine, p-nonylphenyl-α-naphthylamine and p-dodecylphenyl-α-naphthylamine, those of a sulfur class, those of a zinc thiophosphate class and those of a phenothiazine class.

The lubricant composition of the invention can find extensive application as a lubricant for use in internal combustion engines such as two- and four-cycle gasoline engines for two- and four-wheeled vehicles, land and marine diesel engines, gas engines and the like, as a hydraulic fluid for hydraulic equipment, construction machinery, injection molding machines, machine tools, hydraulically actuated robots and the like, as a lubricant for compressors of a rotatable, reciprocating or turbo type to compress gases, as a shock absorber lubricant for automobile suspensions, as a gear oil for automotive gears and other industrial gears, as an automatic transmission fluid, as a vacuum pump oil, as a refrigerator oil, as a metal machining oil for cutting, grinding, rolling, pressing, drawing, drawing-ironing wiping and the like, as a slide surface guiding oil, as a bearing oil and the like.

The following examples are given to further illustrate the invention. In these examples all percentages are indicated by weight unless otherwise noted.

INVENTIVE EXAMPLE 1

A starting oil fraction, WVGO, shown in Table 1 was subjected to hydrocracking at medium pressure and at low LHSV as listed in Table 2, and then to solvent dewaxing and furfural dearomatization, thereby producing a lubricant base oil according to the invention. The resulting SAE-10 grade oil showed a high aromtics content of 9.5%, meaning sufficient dissolution of additive and sludge. The base oil was as high as 122 in viscosity index due to isoparaffins and monocyclic naphthenes being preferably abundant, say 66.1%. Tri-, tetra- and penta-cyclic aromatics harmful for heat stability were negligibly small in content. A raffinate yield was as high as 90.2% and rich in desirable alkylbenzenes.

INVENTIVE EXAMPLE 2

The dewaxed oil obtained in Inventive Example 1 was dearomatized with furfural in a volume ratio of solvent to oil of 3.0. Tri- and tetra-cyclic aromatics in the aromatics content was in a trace, and heat stability was acceptable with an ASTM color of L2.5. Medium to low pressure, low LHSV hydrocracking has been proved to selectively remove polycyclic aromatics as objectionable components.

INVENTIVE EXAMPLE 3

HIX of Table 1 was medium pressure-hydrocracked, solvent-dewaxed and solvent-dearomatized as shown in Table 2, thereby providing a base oil of an SAE-10 grade. The base oil was as high as 6.1% in aromatics content and hence sufficient to dissolve additives and sludge. The viscosity index was noticeably great, say 127, due to isoparaffins and monocyclic naphthenes being as rich as 70.1% in that oil. Heat stability was adequate as tri-, tetra- and penta-cyclic aromatics were nearly absent. Raffinate was available in a 91.8% yield with a high content of alkylbenzenes.

INVENTIVE EXAMPLE 4

The hydrocracked oil obtained in Inventive Example 3 was hydrogenated under the high pressure and medium LHSV conditions listed in Table 2. Tri- and tetra-cyclic aromatics in the aromatics content were reduced to 0.8% equivalent to 0.1% in the base oil. Heat stability was acceptable.

INVENTIVE EXAMPLE 5

The base oil of Inventive Example 3 hydrofinished at low pressure as shown in Table 2. The resulting oil showed a decline in tri- to penta-cyclic aromatics and resin, thus improving photostability even for 4 days. Low pressure hydrofinishing has been found to remarkably enhance photostability.

INVENTIVE EXAMPLE 6

The base oil of Inventive Example 3 was hydrofinished at a medium level of pressure and LHSV with the result that the aromatics content was decreased to 0.7%.

INVENTIVE EXAMPLE 7

The hydrocracked oil of Inventive Example 3 was MEK-dewaxed at −45° C. and furfural-dearomatized in a volume ratio of solvent to oil of 2.0. The pour point was reduced at −35° C. Isoparaffins and monocyclic naphthenes were relatively rich in a total content of 67.1% so that the viscosity index was as high as 121. Heat stability was highly satisfactory with a trace of tri- to penta-cyclic aromatics.

INVENTIVE EXAMPLE 8

HIX was hydrocracked at medium pressure and low LHSV, catalysis-dewaxed and furfural-dearomatized, whereby there was obtained a base oil of an SAE-10 grade. The aromatics content was as high as 6.8% so that additives and sludge were easily dissolable. The viscosity index was 123 with isoparaffins and monocyclic naphthenes as high as 68.0%. Alkylbenzenes were preferably rich, whereas tri- to penta-cyclic aromatics were nearly absent.

INVENTIVE EXAMPLE 9

DAO of Table 1 was hydrocracked at medium pressure and at low LHSV, solvent-dewaxed and furfural-dearomatized to give a base oil of an SAE-10 grade. The aromatics content was as high as 7.8%, and therefore, additives and sludge were easy to dissolve. The viscosity index was 121 with a total content of 65.1% of isoparaffins and monocyclic naphthenes. Alkylbenzenes were abundant as against a trace of tri- to penta-cyclic aromatics.

COMPARATIVE EXAMPLE 1

WVGO of Table 1 was hydrocracked at a high level of pressure and LHSV as shown in Table 3 and dearomatized with furfural to provide a comparative base oil of an SAE-10 grade. The aromatics content was as low as 3.8% so that additives and sludge were not sufficiently dissolvable. A total content of isoparaffins and monocyclic naphthenes were small, say 55.4%, with a unacceptably small viscosity index of 110. Tri- to penta-cyclic aromatics were objectionably rich and hence responsible for inadequate heat stability of the base oil. Alkylbenzenes were in too small a content.

COMPARATIVE EXAMPLE 2

The hydrocracked oil of Comparative Example 1 was solvent-dewaxed. The resulting base oil was insufficient in heat stability.

COMPARATIVE EXAMPLE 3

The solvent-dewaxed base oil of Comparative Example 2 was dearomatized with furfural in a volume ratio of solvent to oil of 2.0. Tri- and tetra-cyclic aromatics were present in an amount of 8.1% in the aromatics content which was equivalent to 0.3% in the base oil. Heat stability was not adequate.

COMPARATIVE EXAMPLE 4

The procedure of Comparative Example 3 was followed except that the solvent to oil ratio was varied at 3.0. Tri- and tetra-cyclic aromatics decreased to 6.0% corresponding to 0.2% in the base oil, resulting in acceptance of heat stability. In such instance, however, dearomatization entailed extraction of alkylbenzene, leading to a low yield of 72.1% of raffinate. High pressure, high LHSV hydrocracking was not capable of selective removal of polycyclic aromatics even on dearomatization.

COMPARATIVE EXAMPLE 5

An oil hydrocracked at medium pressure and at low LHSV as was in Inventive Example 1 was solvent-dewaxed. The resultant base oil revealed insufficient heat stability.

INVENTIVE EXAMPLES 10–11 AND COMPARATIVE EXAMPLES 6–11

Different lubricant compositions were prepared as shown in Tables 4–6. The lubricants of Tables 4 and 5 were formulated for use in gasoline engines and those of Table 6 for application to diesel engines. Performance evaluation was made under the conditions given below.

Viscosity Characteristics at Low Temperature (Table 4)

JIS K-2215 was followed in testing apparent viscosity at low temperature (CCS viscosity). Viscosities were measured both at −15° C. and at −20° C. with each test lubricant in which was contained a base oil prepared to be 6.6 cSt at 100° C. All the lubricants of Table 4 were set to be identical in viscosity at 100° C. with addition of the additive and viscosity builder.

Viscosity Characteristics at High Temperature and at High Shear (Table 5)

CECH L-36-T-84 was followed with a shear velocity of 106s-1 at 100° C.

Evaporation Loss (Table 5)

CEC L-40-7-87 was followed with a test time of one hour at 250° C.

Oxidation Stability (Table 5)

JIS K-2514 was followed with a temperature of 165.5° C. and a time length of 72 hours. Determination was made with respect to viscosity ratio, base number residue and acid number increase.

Panel Coking (Table 5)

Tentative Standard Method 3462-T of Federal 791 was followed with a panel temperature of 320° C., an oil temperature of 100° C., an actuation time of 15 seconds of and a termination time of 45 seconds of splash rod and a test time of 3 hours.

To check the above qualities, all the lubricants are set to have the same viscosity characteristics at low temperature (3,200 cP at −20° C.) by adjustment of the amounts of the base oil and viscosity improver. To be more specific, the results listed in Table 4 are those obtained with a 10W-40 oil of each of the test base oils.

INVENTIVE EXAMPLE 12 AND COMPARATIVE EXAMPLES 12–14

Different hydraulic fluids were formulated as shown in Table 7 and examined for a set of physical characteristics indicated below.

Viscosity Index

Viscosities were measured both at 40° C. and at 100° C., whereupon the viscosity index was counted by the JIS K-2283 procedure. All the fluids were set to be substantially identical in viscosity at 40° C. with use of the additive and viscosity index improver shown in Table 4.

Oxidative Stability

A rotatable bomb type oil tester stipulated by JIS K-2514 was used to determine oxidation lifetime at 150° C.

Test at High Temperature and at High Shear

ASTM O-2603 was followed in checking shear stability at a temperature of 150° C. and at a shear velocity of $10^6$ $sec^{-1}$.

Hydraulic Pump Volume Efficiency

A Vickers V-104C pump was used to examine volume efficiency at 140 kg/cm$^2$, at 1,200 ppm and at 60°, 80° and 100° C.

INVENTIVE EXAMPLE 13 AND COMPARATIVE EXAMPLE 15

Two different lubricants were formulated as shown in Table 8 and subjected to the following tests.

Viscosity Characteristics and Pour Point

Viscosity index, lower temperature viscosity and pour point were measured by the methods of Table 8.

Oxidative Stability (1)

Oxidation lifetime was measured by a rotatable bomb type oil stability test (RBOT) of JIS K-2514.

Oxidative Stability (2)

An internal engine oil stability test (ISOT) of JIS K-2514 was conducted to determine additive residue, viscosity ratio and acid number increase.

INVENTIVE EXAMPLES 14–15 AND COMPARATIVE EXAMPLES 16–19

Different lubricants were formulated, as shown in Tables 9 and 10, with the viscosity of base oil and the amount of viscosity index improver varied. The lubricants were particularly for use in Strat type shock absorbers. Evaluation was made under the following conditions.

Viscosity Index

JIS K-2283 was followed. Kinematic viscosities were measured at 40° and 100° C. All the lubricants were set at 10 cSt at 40° C. with addition of additive and viscosity index improver as seen in Tables 9 and 10.

Oxidative Stability

ISOT of JIS K-2514 was followed in checking viscosity ratio, acid number increase and hue. Test conditions were at 130° C. for 24 hours.

Evaporation Loss

JIS K-2514 was followed under 120° C.-temperature and 24-hour time conditions.

TABLE 1

| Oil Fraction | DAO | WVGO | HIX |
|---|---|---|---|
| specific gravity, 15/4° C. | 0.926 | 0.926 | 0.884 |
| kinematic viscosity, cSt, | | | |
| 50° C. | — | 62.61 | 21.37 |
| 75° C. | 113.9 | — | — |
| 100° C. | 42.66 | 10.44 | 6.55 |
| pour point, °C. | >+45 | 40.0 | 42.5 |
| aniline point, °C. | 110.7 | 81.8 | 88.2 |
| sulfur content, ppm | 20400 | 19000 | 1100 |
| nitrogen content, ppm | 600 | 1000 | 190 |

TABLE 2

| | Inventive Examples | | | | | | | | |
|---|---|---|---|---|---|---|---|---|---|
| | 1 | 2 | 3 | 4 | 5 | 6 | 7 | 8 | 9 |
| Oil fraction*1) | WVGO | WVGO | HIX | HIX | HIX | HIX | HIX | HIX | DAO |
| hydrocracking*2) | | | | | | | | | |
| total pressure, kg/cm$^2$ | 130 | 130 | 130 | 130 | 130 | 130 | 130 | 130 | 130 |
| LHSV, $hr^{-1}$ | 0.3 | 0.3 | 0.3 | 0.3 | 0.3 | 0.3 | 0.3 | 0.3 | 0.3 |
| temperature, °C. | 405 | 405 | 395 | 395 | 395 | 395 | 395 | 395 | 405 |
| cracking ratio*3) | 71 | 71 | 55 | 55 | 55 | 55 | 55 | 55 | 75 |
| solvent dewaxing*4) | | | | | | | | | |
| solvent/oil, vol ratio | 1.0 | 1.0 | 1.0 | 1.0 | 1.0 | 1.0 | 2.0 | — | 1.0 |
| temperature, °C. | −23 | −23 | −23 | −23 | −23 | −23 | −45 | — | −23 |
| catalytic dewaxing*5) | | | | | | | | | |
| total pressure, kg/cm$^2$ | — | — | — | — | — | — | — | 40 | — |
| LHSV, $hr^{-1}$ | — | — | — | — | — | — | — | 0.5 | — |
| temperaturem, °C. | — | — | — | — | — | — | — | 300 | — |
| solvent dearomatization (furfural) | | | | | | | | | |
| solvent/oil, vol ratio | 1.5 | 3.0 | 1.5 | — | 1.5 | 1.5 | 1.5 | 1.5 | 1.5 |
| temperature, °C. | 120 | 125 | 120 | — | 120 | 120 | 120 | 120 | 120 |
| raffinate yield, wt % | 90.2 | 71.3 | 91.8 | — | 91.8 | 91.8 | 91.8 | 91.8 | 90.8 |
| hydrogenation*6) | | | | | | | | | |
| total pressure, kg/cm$^2$ | — | — | — | 200 | 30 | 100 | — | — | — |
| LHSV, $hr^{-1}$ | — | — | — | 1.0 | 0.5 | 0.5 | — | — | — |
| composition, wt % | | | | | | | | | |
| saturates content | 90.2 | 95.4 | 93.7 | 99.1 | 94.5 | 99.2 | 93.2 | 93.0 | 92.0 |
| aromatics content | 9.5 | 4.4 | 6.1 | 0.8 | 5.4 | 0.7 | 6.6 | 6.8 | 7.8 |
| resin content | 0.3 | 0.2 | 0.2 | 0.1 | 0.1 | 0.1 | 0.2 | 0.2 | 0.2 |
| composition in saturates content | | | | | | | | | |
| isoparaffin + monocyclic naphtene | 66.1 | 67.3 | 70.1 | 68.9 | 69.5 | 68.8 | 67.1 | 68.0 | 65.1 |
| polycyclic naphthene | 33.9 | 32.7 | 29.9 | 31.1 | 30.5 | 31.2 | 32.9 | 32.0 | 34.9 |

TABLE 2-continued

| | Inventive Examples | | | | | | | | |
|---|---|---|---|---|---|---|---|---|---|
| | 1 | 2 | 3 | 4 | 5 | 6 | 7 | 8 | 9 |
| composition in aromatics content | | | | | | | | | |
| alkylbenzene | 45.8 | 62.8 | 43.4 | 35.5 | 41.0 | 34.3 | 43.2 | 42.1 | 45.6 |
| naphthene benzene | 40.8 | 34.7 | 43.6 | 56.2 | 45.7 | 65.7 | 43.6 | 44.5 | 57.6 |
| dicyclic aromatic | 10.7 | 2.5 | 11.1 | 7.4 | 11.8 | 0.2 | 11.4 | 11.3 | 9.5 |
| tri-tetra-cyclic aromatics | 2.1 | trace | 1.6 | 0.8 | 1.3 | 0.0 | 1.6 | 1.6 | 2.0 |
| pentacyclic aromatic | 0.6 | trace | 0.3 | 0.1 | 0.2 | 0.0 | 0.2 | 0.3 | 0.5 |
| SAE-10 property | | | | | | | | | |
| viscosity index | 122 | 125 | 127 | 128 | 127 | 128 | 121 | 123 | 121 |
| pour point, °C. | −15 | −15 | −15 | −15 | −15 | −15 | −35 | −15 | −15 |
| heat stability | | | | | | | | | |
| evaluation | | | | | acceptable | | | | |
| color, ASTM | L5.0 | L2.5 | L3.0 | L2.5 | L3.0 | L2.5 | L3.5 | L4.0 | L4.5 |
| photostability*7) day | — | — | 6 | — | 10 | — | — | — | — |

Notes to Table 2
*1)as shown in Table 1
*2)commercially available catalyst $SiO_2$—$Al_2O_3$, Ni 10 wt %, W 20 wt %
*3)DAO at 530° C., WVGO and HIX at 360° C.
*4)MEK/toluene solvent
*5)commercially available catalyst pentacylsil type zeolite
*6)commercially available catalyst $SiO_2$—$Al_2O_3$, Ni 3 wt %, Mo 15 wt %
*7)outdoor exposure, day required for sludge to form

TABLE 3

| | Comparative Examples | | | | |
|---|---|---|---|---|---|
| | 1 | 2 | 3 | 4 | 5 |
| Oil Fraction*1) | WVGO | WVGO | WVGO | WVGO | WVGO |
| hydrocracking*2) | | | | | |
| total pressure, kg/cm$^2$ | 200 | 200 | 200 | 200 | 130 |
| LHSV, hr$^{-1}$ | 1 | 1 | 1 | 1 | 0.3 |
| temperature, °C. | 410 | 410 | 410 | 410 | 405 |
| cracking ratio*3) | 55 | 55 | 55 | 55 | 71 |
| solvent dewaxing*4) | | | | | |
| solvent/oil, vol ratio | 1.0 | 1.0 | 1.0 | 1.0 | 1.0 |
| temperature, °C. | −23 | −23 | −23 | −23 | −23 |
| solvent dearomatization (furfural) | | | | | |
| solvent/oil, vol ratio | 1.5 | — | 2.0 | 3.0 | — |
| temperature, °C. | 120 | — | 120 | 125 | — |
| raffinate yield, wt % | 92.3 | — | 88.5 | 72.1 | — |
| hydrogenation*6) | | | | | |
| total pressure, kg/cm$^2$ | — | — | — | — | — |
| LHSV, hr$^{-1}$ | — | — | — | — | — |
| composition, wt % | | | | | |
| saturates content | 96.1 | 95.1 | 96.0 | 96.9 | 88.9 |
| aromatics content | 3.8 | 4.8 | 3.9 | 3.0 | 10.7 |
| resin content | 0.1 | 0.1 | 0.1 | 0.1 | 0.4 |
| composition in saturates content | | | | | |
| isoparaffin + monocyclic naphtene | 43.3 | 43.2 | 44.0 | 45.3 | 65.5 |
| polycyclic naphthene | 56.7 | 56.8 | 54.7 | 54.7 | 34.5 |
| composition in aromatics content | | | | | |
| alkylbenzene | 27.5 | 24.5 | 28.6 | 29.5 | 42.8 |
| naphthene benzene | 51.7 | 48.3 | 52.9 | 57.2 | 23.7 |
| dicyclic aromatic | 10.9 | 15.3 | 9.5 | 7.3 | 18.1 |
| tri-tetra-cyclic aromatics | 8.8 | 10.5 | 8.1 | 6.0 | 13.8 |
| pentacyclic aromatic | 1.1 | 1.4 | 0.9 | trace | 1.6 |
| SAE-10 property | | | | | |
| viscosity index | 110 | 107 | 111 | 113 | 118 |
| pour point, °C. | −15 | −15 | −15 | −15 | −15 |
| heat stability | | | | | |
| evaluation | | unacceptable | | acceptable | unacceptable |
| color, ASTM | D8.0 | D8.0 | L7.0 | L3.0 | D8.0 |

*1)–*6) see notes to Table 2

TABLE 4

| Lubricant | Inventive Example 10 | Comparative Examples 6 | 7 |
|---|---|---|---|
| base oil | | | |
| 6.6 mm$^2$/s at 100° C. | 100 | — | — |
| aromatics 9.5 wt % | | | |
| sulfur 2 ppm | | | |
| nitrogen 1 ppm | | | |
| hydrocracked oil | — | 100 | — |

TABLE 4-continued

| Lubricant | Inventive Example 10 | Comparative Examples 6 | 7 |
|---|---|---|---|
| (commercial) | | | |
| 6.6 mm$^2$/s at 100° C. | | | |
| aromatics 1.0 wt % | | | |
| sulfur 1 ppm | | | |
| nitrogen 1 ppm | | | |
| solvent refined oil | — | — | 100 |

TABLE 4-continued

| Lubricant | Inventive Example 10 | Comparative Examples 6 | 7 |
|---|---|---|---|
| (commercial) | | | |
| 6.6 $mm^2/s$ at 100° C. | | | |
| aromatics 26.0 wt % | | | |
| sulfur 2900 ppm | | | |
| nitrogen 34 ppm | | | |
| SG package additive (commercial) | 10.0 | 10.0 | 10.0 |
| olefin copolymer | 8.0 | 8.0 | 8.0 |
| CCS viscosity, cP, | | | |
| −15° C. | 1890 | 3230 | 3230 |
| −20° C. | 3270 | 6800 | 7000 |

composition: weight part

TABLE 5

| Lubricant | Inventive Example 10 | Comparative Examples 8 | 9 |
|---|---|---|---|
| base oil | | | |
| 6.6 $mm^2/s$ at 100° C. | 100 | — | — |
| aromatics 9.5 wt % | | | |
| sulfur 2 ppm | | | |
| nitrogen 1 ppm | | | |
| hydrocracked oil (commercial) | — | 100 | — |
| 5.0 $mm^2/s$ at 100° C. | | | |
| aromatics 1.0 wt % | | | |
| sulfur 1 ppm | | | |
| nitrogen 1 ppm | | | |
| solvent refined oil (commercial) | — | — | 100 |
| 5.0 $mm^2/s$ at 100° C. | | | |
| aromatics 24.0 wt % | | | |
| sulfur 2500 ppm | | | |
| nitrogen 31 ppm | | | |
| SG package additive (commercial) | 10.0 | 10.0 | 10.0 |
| olefin copolymer | 8.0 | 11.0 | 11.0 |
| TBS viscosity, cP, 150° C. | 4.1 | 3.9 | 3.7 |
| evaporation loss, wt % | 6.8 | 12.8 | 15.0 |
| ISO test | | | |
| viscosity ratio, 100° C. | 0.95 | 0.93 | 0.92 |
| base residue, HCl method, % | 9 | 0 | 0 |
| acid number increase, mg KOH/g | +0.23 | +1.29 | +2.23 |
| panel cooking test coking amount, mg | 53.0 | 173.0 | 63.8 |

composition: weight part

TABLE 6

| Lubricant | Inventive Example 11 | Comparative Examples 10 | 11 |
|---|---|---|---|
| base oil | | | |
| 6.6 $mm^2/s$ at 100° C. | 100 | — | — |
| aromatics 9.5 wt % | | | |
| sulfur 2 ppm | | | |
| nitrogen 1 ppm | | | |
| hydrocracked oil (commercial) | — | 100 | — |
| 4.8 $mm^2/s$ at 100° C. | | | |
| aromatics 1.0 wt % | | | |
| sulfur 1 ppm | | | |
| nitrogen 1 ppm | | | |
| solvent refined oil (commercial) | — | — | 100 |
| 4.8 $mm^2/s$ at 100° C. | | | |
| aromatics 24.0 wt % | | | |
| sulfur 2500 ppm | | | |
| nitrogen 31 ppm | | | |
| CD package additive (commercial) | 13.0 | 13.0 | 13.0 |
| olefin copolymer | 4.5 | 6.5 | 6.5 |

TABLE 6-continued

| Lubricant | Inventive Example 11 | Comparative Examples 10 | 11 |
|---|---|---|---|
| oil property | | | |
| viscosity ratio, 100° C. | 1.25 | 1.56 | 1.66 |
| base residue, HCl method, % | 35 | 33 | 28 |
| acid number increase, mg KOH/g | +3.53 | +4.35 | +4.15 |
| oil consumption, g/h | 41.1 | 46.2 | 50.4 |
| engine cleanability | | | |
| ring groove deposit (TGF) | 25.1 | 21.0 | 56.2 |
| skirt deposit | 9.91 | 9.90 | 8.50 |
| underside deposit | 8.6 | 7.6 | 7.7 |
| oil sludge, average | 9.6 | 9.6 | 9.0 |
| piston ring weight loss (TGF), mg | 18.6 | 24.3 | 20.6 |
| cam nose wear, 1/1000 mm | 0.9 | 5.2 | 4.6 |
| tappet wear, mg | 3.0 | 9.3 | 4.8 |

composition: weight part

TABLE 7

| Lubricant/Performance | Inventive Example 12 | Comparative Examples 12 | 13 | 14 |
|---|---|---|---|---|
| base oil*) | A | B | B | C |
| tricresyl phosphate | 0.5 | 0.5 | 0.5 | 0.5 |
| di-t-butyl-p-cresol | 0.5 | 0.5 | 0.5 | 0.5 |
| polymethacrylate (MW: ca $7 \times 10^4$) | — | 5.0 | — | — |
| kinematic viscosity, cSt, | | | | |
| 40° C. | 32.0 | 32.1 | 32.2 | 32.0 |
| 100° C. | 6.05 | 6.14 | 5.42 | 5.42 |
| viscosity index | 138 | 142 | 102 | 101 |
| oxidative resistance, min | 402 | 85 | 90 | 230 |
| shear stability | 2.75 | 2.53 | 2.40 | 2.40 |
| volumetric efficiency, hydraulic pump, %, | | | | |
| 60° C. | 83.2 | 81.0 | 81.0 | 81.1 |
| 80° C. | 77.5 | 75.5 | 74.2 | 74.3 |
| 100° C. | 69.0 | 66.6 | 66.0 | 66.1 |

*)
A: according to the invention
B: Arabian orign, solvent refined
C: Sumatran origin, solvent refined

TABLE 8

| Lubricant/ Performance | Inventive Example 13 | Comparative Example 15 | Test Method |
|---|---|---|---|
| base oil | | | |
| kinematic viscosity, cSt, 40° C. | 18.7 | 30.2 | JIS-K-2283 |
| viscosity index | 121 | 108 | JIS-K-2283 |
| pour point, °C. | −17.5 | −12.5 | JIS-K-2269 |
| aromatics, wt % | 9.5 | 10.8 | ASTM-D-2549 |
| composition | | | |
| antioxidant, | | | |
| naphthylamine type | 1.0 | 1.0 | |
| polymethacrylate | 0.1 | 0.1 | |
| base oil | balance | balance | |
| performance | | | |
| viscosity index | 130 | 122 | JIS-K-2283 |
| low temperature viscosity, cP, | | | |
| −18° C. | 750 | 1650 | JIS-K-2215 |
| −20° C. | 980 | 2350 | ASTM-D-3829 |
| pour point, °C. | −30 | −20 | JIS-K-2269 |
| RBOT, min | 2500 | 1500 | JIS-K-2514 |
| ISOT | | | JIS-K-2514 |
| effective additive residue, % | 60 | 20 | |
| viscosity ratio, % | 1.00 | 1.01 | |
| total acid number increase (mg | 0.00 | 0.00 | |

TABLE 8-continued

| Lubricant/ Performance | Inventive Example 13 | Comparative Example 15 | Test Method |
|---|---|---|---|
| KOH/g) | | | |

TABLE 9

| Lubricant | Inventive Example 14 | Comparative Examples 16 | 17 |
|---|---|---|---|
| hydrocracked oil (inventive) 7.3 cSt at 40° C. aromatics 8.0 wt % sulfur 2 ppm nitrogen 1 ppm | 92.6 | — | — |
| hydrocracked oil (commercial) 7.3 cSt at 40° C. aromatics 1.0 wt % sulfur 1 ppm nitrogen 1 ppm | — | 92.6 | — |
| solvent refined oil (commercial) 7.3 cSt at 40° C. Aromatics 26.0 wt % sulfur 2900 ppm nitrogen 34 ppm | — | — | 92.6 |
| strat package additive | 3.4 | 3.4 | 3.4 |
| polymethacrylate | 4.0 | 4.0 | 4.0 |
| viscosity index | 168 | 162 | 160 |
| evaporation loss, wt % | 15.8 | 19.7 | 20.6 |
| oxidation stability, internal engine | | | |
| viscosity ratio, 40° C. | 1.00 | 1.06 | 1.10 |
| acid number increase, mg KOH/g | +0.35 | +0.40 | +0.40 |
| hue, ASTM | L4.5 | L4.5 | L4.5 |

composition: weight part

TABLE 10

| Lubricant | Inventive Example 14 | Comparative Examples 18 | 19 |
|---|---|---|---|
| hydrocracked oil (inventive) 3.5 cSt at 40° C. aromatics 8.0 wt % sulfur 2 ppm nitrogen 1 ppm | 88.8 | — | — |
| hydrocracked oil (commercial) 7.3 cSt at 40° C. aromatics 1.0 wt % sulfur 1 ppm nitrogen 1 ppm | — | 88.8 | — |
| solvent refined oil (commercial) 3.5 cSt at 40° C. Aromatics 26.0 wt % sulfur 2900 ppm nitrogen 34 ppm | — | — | 88.8 |
| strat package additive | 3.2 | 3.2 | 3.2 |
| polymethacrylate | 8.0 | 8.0 | 8.0 |
| viscosity index | 405 | 400 | 397 |
| evaporation loss, wt % | 30.6 | 36.6 | 39.0 |
| oxidation stability, internal engine | | | |
| viscosity ratio, 40° C. | 1.18 | 1.26 | 1.32 |
| acid number increase, mg KOH/g | +1.20 | +1.32 | +1.32 |
| hue, ASTM | L3.0 | L3.5 | L3.5 |

composition: weight part

What is claimed is:

1. A base oil for use in lubricants which comprises:

(a) 2–15% by weight of a total aromatics content;

(b) greater than 60% by weight of isoparaffins and monocyclic naphthenes in total in a saturates content;

(c) more than 30% by weight of alkylbenzenes in the total aromatics content; and (d) less than 4% by weight of tricyclic and tetracyclic aromatics in the total aromatics content, whereby the base oil has a viscosity index greater than 105 and a pour point lower than −10° C., said base oil being produced by the steps of:

hydrocracking a starting oil fraction to a cracking ratio of higher than 40% by weight in the presence of a hydrocracking catalyst at a total pressure of less than 150 kg/cm$^2$, at a temperature of 360°–440° C. and at a liquid hourly space velocity of less than 0.5 hr$^{-1}$, said starting oil fraction being a whole vacuum gas oil, a heavy vacuum gas oil resulting from mild hydrocracking of a whole vacuum gas oil, or a mixture thereof;

recovering an oil fraction as hydrocracked or a lubricating cut alone; and dewaxing the thus recovered oil fraction prior to or subsequent to dearomatization.

2. A base oil as defined in claim 1, wherein the total aromatics content is 3–10% by weight.

3. A base oil as defined in claim 1, wherein the heavy vacuum gas oil is derived by vacuum distillation of a residual oil generated upon atmospheric distillation of crude oil.

4. A base oil as defined in claim 1, wherein the heavy vacuum gas oil boils at 360°–530° C.

5. A base oil as defined in claim 1, wherein said mild hydrocracking is carried out at a total pressure of less than 100 kg/cm$^2$ at a temperature of 370°–450° C. and at a liquid hourly space velocity of 0.5–4.0 hr$^{-1}$.

6. A base oil for lubricants, said base oil having a viscosity index greater than 105 and a pour point lower than −10° C. and comprising (i) 3–10% by weight of total aromatics content and (ii) 90% by weight or more of total saturates content, wherein said base oil has (a) an isoparaffins plus monocyclic naphthenes content of greater than 60% by weight of total saturates content, (b) an alkylbenzenes content of more than 30% by weight of total aromatics content, and (c) a tricyclic and tetracyclic aromatics content of less than 4% by weight of total aromatics content.

7. A process for producing a base oil for lubricants, which comprises:

(1) hydrocracking a starting oil fraction at a rate greater than 40% by weight in the presence of a hydrocracking catalyst at a total pressure of less than 150 kg/cm$^2$, at a temperature of 360°–440° C. and at a liquid hourly space velocity of less than 0.5 hr$^{-1}$, said starting oil fraction being a whole vacuum gas oil, a heavy vacuum gas oil resulting from mild hydrocracking of whole vacuum gas oil, or mixtures thereof;

(2) recovering an oil fraction as hydrocracked or as a lubricating cut alone; and dewaxing and then dearomatizing said oil fraction or dearomatizing and then dewaxing said oil fraction, thereby obtaining a base oil having a viscosity index greater than 105 and a pour point lower than −10° C. and comprising (i) 3–10% by weight of total aromatics content and (ii) 90% by weight or more of total saturates content, wherein said base oil has (a) an isoparaffins plus monocyclic naphthenes content of greater than 60% by weight of total saturates content, (b) an alkylbenzenes content of more than 30% by weight of total aromatics content, and (c) a tricyclic and tetracyclic aromatics content of less than 4% by weight of total aromatics content.

8. A process according to claim 7; wherein the dearomatization is effected in a volume ratio of solvent to oil fraction of less than 2 with furfural used as the solvent.

9. A process according to claim 7; wherein a raffinate is obtained in a yield of greater than 85% by weight by the dearomatization.

10. A process according to claim 7; wherein the dearomatization is effected in a volume ratio of solvent to oil fraction of less than 2 with N-methyl-2-pyrrolidone used as the solvent.

11. A process for producing a base oil for use in lubricants, which comprises:

(1) hydrocracking a starting oil fraction at a rate greater than 40% by weight in the presence of a hydrocracking catalyst at a total pressure of less than 150 $kg/cm^2$, at a temperature of 360°–440° C. and at a liquid hourly space velocity of less than 0.5 $hr^{-1}$, said starting oil fraction being a whole vacuum gas oil, a heavy vacuum gas oil resulting from mild hydrocracking of whole vacuum gas oil, or a mixture thereof;

(2) recovering an oil fraction as a hydrocracking lubricating cut alone; and (3) dewaxing and then dearomatizing said oil fraction or dearomatizing and then dewaxing said oil fraction, thereby obtaining a base oil having a viscosity index greater than 105 and a pour point lower than −10° C. and comprising (i) 3–10% by weight of total aromatics content and (ii) 90% by weight or more of total saturates content, wherein said base oil has (a) an isoparaffins plus monocyclic naphthenes content of greater than 60% by weight of total saturates content, (b) an alkylbenzenes content of more than 30% by weight of total aromatics content, and (c) a tricyclic and tetracyclic aromatics content of less than 4% by weight of total aromatics content; and wherein said base oil possesses one of the following requirements:

(d) a viscosity index greater than 105 and a pour point lower than −10° C. as a 70 pale cut;

(e) a viscosity index greater than 115 and a pour point lower than −10° C. as a SAE-10 cut;

(f) a viscosity index greater than 120 and a pour point lower than −10° C. as an SAE-20 cut;

(g) a viscosity index greater than 120 and a pour point lower than −10° C. as an SAE-30 cut.

12. A process according to claim 11; wherein the dearomatization is effected in a volume ratio of solvent to oil fraction of less than 2 with furfural used as the solvent.

13. A process according to claim 11; wherein a raffinate is obtained in a yield of greater than 85% by weight by the dearomatization.

14. A process according to claim 11; wherein the dearomatization is effected in a volume ratio of solvent to oil fraction of less than 2 with N-methyl-2-pyrrolidone used as the solvent.

* * * * *